United States Patent [19]

Hendrickx

[11] 4,113,093

[45] Sep. 12, 1978

[54] PACKAGE CONVERTIBLE INTO A DISPLAY MEANS FOR CUT FLOWERS

[76] Inventor: Yves Hendrickx, Rte. d', Orleans, France, F-45000

[21] Appl. No.: 765,545

[22] Filed: Feb. 4, 1977

[30] Foreign Application Priority Data

Feb. 9, 1976 [BE] Belgium ..... 164178
Jan. 19, 1977 [BE] Belgium ..... 174217

[51] Int. Cl.[2] ..... B65D 85/52

[52] U.S. Cl. ..... 206/423; 206/486; 47/84

[58] Field of Search ..... 206/423, 45.13, 486, 206/490, 303; 229/51 DB; 47/84

[56] References Cited

U.S. PATENT DOCUMENTS

| | | | |
|---|---|---|---|
| 1,469,536 | 10/1923 | Risley | 206/423 |
| 2,056,032 | 9/1936 | Berman | 229/51 DB |
| 3,314,194 | 4/1967 | Halleck | 47/84 |
| 3,872,621 | 3/1975 | Greenbaum | 206/423 |
| 3,884,348 | 5/1975 | Ron | 229/51 DB |
| 3,916,565 | 11/1975 | Runyon | 206/423 |
| 3,924,354 | 12/1975 | Gregoire | 206/423 |

FOREIGN PATENT DOCUMENTS

| | | | |
|---|---|---|---|
| 1,469,650 | 1/1967 | France | 47/84 |
| 1,413,806 | 8/1965 | France | 206/423 |
| 15,001 | 12/1926 | Netherlands | 206/423 |

*Primary Examiner*—Herbert F. Ross
*Attorney, Agent, or Firm*—Kurt Kelman

[57] ABSTRACT

A package convertible into a display for selectively transporting, storing and displaying cut flowers comprises a box-shaped casing whose side walls have a height sufficient for accommodating the cut flowers disposed in a vertical position, a cup of a water-impervious material at the bottom of the casing and forming a part thereof, score lines on the side walls defining a plane above the cup for cutting the side walls along the score lines when the package is converted into the display, and a support for the cut flowers extending above the cup and defining an opening for receiving the stems of the flowers when the side walls are cut and the package has been converted into the display.

9 Claims, 5 Drawing Figures

PACKAGE CONVERTIBLE INTO A DISPLAY MEANS FOR CUT FLOWERS

This invention relates to a package convertible into a display means for the sending, the storage and the display for sale of cut flowers.

Heretofore, when sending cut flowers, they are generally placed lying in cardboard boxes totally free from water.

In addition, the flowers lie one upon the other and, according, the flowers situated at the lower level are damaged by being crushed.

In addition, when arriving at the sale or storage location, the flowers must be removed from the cardboard box in which they are supplied and transferred into a container containing water for the preservation thereof.

Attempts have been made to transport cut flowers in the presence of water. However, the solutions suggested heretofore use conventional containers which, on the one hand, are relatively expensive and must be consequently recovered, and additionally are not attractive so that they can hardly be used for display purposes.

It is an object of the present invention to avoid such drawbacks by providing a cheap single use package allowing the transportation of flowers in the presence of water, it being possible to convert said package into an attractive display means for sale of the cut flowers.

The package according to the invention comprises a box-shaped container having a sufficient height for accommodating all the cut flowers disposed in a vertical position, the lower portion of said container comprising a cup of an impervious material, whereas the side walls of the container casing carry score lines defining a plane above the cup for cutting the side walls along these lines when the package is converted into a display means for the cut flowers. A support for the cut flowers extends above the cup and defines at least one opening for receiving the stems of the flowers when the side walls are cut and the package has been converted into the display means.

The invention will be more readily understood with reference to the following description and to the accompanying drawings showing, only by way of example, several embodiments of the invention and wherein.

Figure 1:
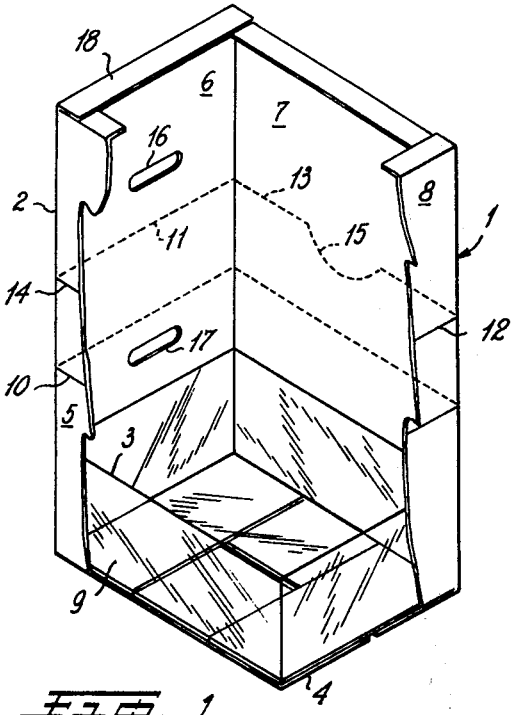
FIG. 1 is a perspective view, partially broken away, of the casing of a container according to the invention.

With reference to FIG. 1, the package according to the invention comprises essentially a box-shaped container 1 having a sufficient height for accommodating the cut flowers to be held therein. Container 1 consists essentially of a casing 2 of a pervious material, such as cardboard, while a bag 3 of a flexible plastic material is made integral with the casing 2 for covering the bottom 4 and the lower portion of the sides 5, 6, 7, 8, thereby forming a cup 9.

The casing 2 has a score line 10 along which the casing is folded when converting the package into a display means for the cut flowers. The outer face of the casing 2 has also straight score lines 11, 12 on the small sides 6 and 8 of the casing 2, and score lines 13, 14 in the median portion of which is provided a curved notch 15 on the large sides 5 and 7.

When converting the package into a display means, the casing is cut along lines 11, 12, 13, 14, 15, as well as through the edges situated between the level of score line 10 and lines 11, 12, 13, 14.

When sending the flowers, they are disposed vertically and completely within the container 1 the cup 9 of which contains water for keeping the cut flowers fresh during transportation; this vertical position prevents the flowers from being crushed and, in addition, owing to the presence of water, the flowers are preserved during the travel.

Figure 3:
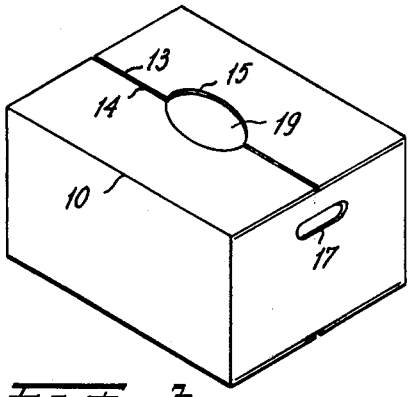
FIG. 3 is a perspective view of a display means obtained after cutting and folding the container shown in FIGS. 1 and 2.

When the flowers are in the shop, water may be added, if desired, so that the flowers are preserved and, as shown in FIG. 3, the package casing will be cut and folded for obtaining a parallelepipedic display means in the center of which is provided a small opening 19 defined by notches 15 to permit the stems of the cut flowers to pass there-through. The display means contains water for preserving the flowers, thereby allowing the displayed bunch of flowers to blossom above a flat surface without seeing the bottom of the stems, thereby forming a particularly pleasant display.

Figure 2:
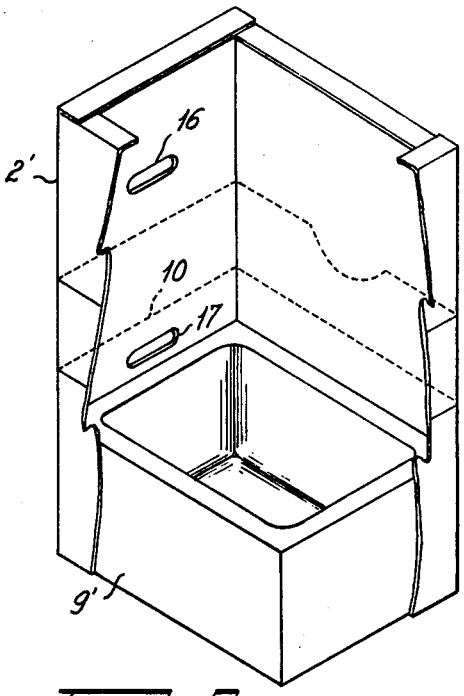
FIG. 2 is also a perspective view, partially broken away, of the casing of a second embodiment of a container according to the invention.

According to the embodiment shown in FIG. 2, the container comprises a bottomless casing 2' the lower portion of which is made integral with a cup 9' of a rigid impervious material; preferably, for economic reasons, an expanded and waterproofed plastic material will be used for the cup.

According to a preferred embodiment of the invention, score line 10 provided for the folding will be situated, relative to the bottom of the container 1, at a level corresponding to the upper level of the leafless portion of the stems of the flowers being sent in this package.

Figure 4:
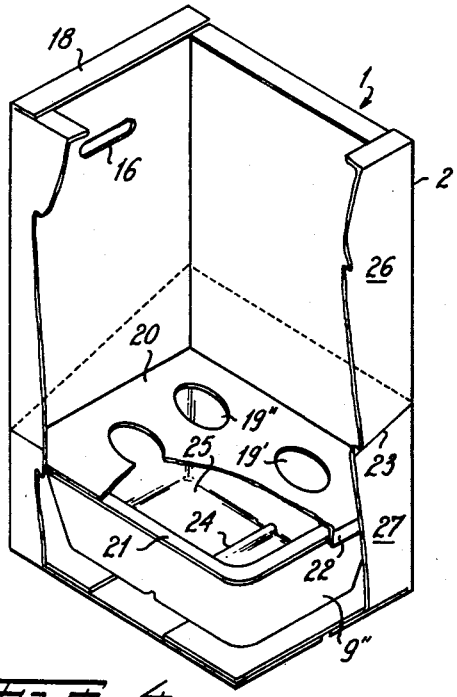
FIG. 4 is a perspective view, partially broken away, of the casing of another embodiment of the invention.

With reference to FIG. 4, the package comprises also a box-shaped container 1 having a sufficient height for accommodating all the cut flowers. Said container 1 consists essentially of a casing 2 of a pervious material, such as cardboard, whereas a cup 9'' of an impervious material is positioned on the bottom of the container 1.

Above the cup 9'', is provided foil 20 having openings 19', 19'' for receiving the stems of the cut flowers.

According to the embodiment shown in FIG. 4, the upper portion of the cup 9'' ends in a rim 21 which supports foil 20. If desired, the foil 20 is also provided with a rim 22 extending over rim 21 of the cup 9'', thereby wedging the foil 20 between rim 21 and the values of casing 2.

Figure 5:
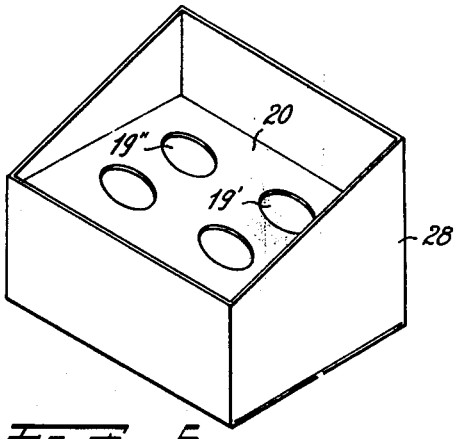
FIG. 5 is a perspective view of a display means obtained after cutting the container shown in FIG. 4.

At a level higher than the upper level of the cup, the outer face of the casing 2 has score line 23 allowing the formation of a display means 28 by cutting the casing 2 along line 23 (see FIG. 5).

According to this extremely simplified embodiment, the flowers are tranported while being completely protected by the casing 2 and while being soaked in water contained in the cup 9'', thereby receiving, throughout the storage or the handling, the amount of water necessary for the preservation thereof, the foil 20 holding the flowers in vertical position because the stems thereof pass through the openings 19', 19''.

In order that the flowers are still better held in vertical position in the package, ribs 24 have been provided in the bottom of the cup 9'' to prevent the stems of the flowers from sliding on the bottom 25 of the cup.

When cutting along line 23, it is possible to remove portion 26 of the casing 2 which is situated above the line 23 of the portion 27 of the casing under the line, said portion 27 comprising the cup 9'', the supporting foil 20 and the flowers. The upper portion of the flowers will project above display means 28.

It will be observed that, in the embodiment shown in FIGS. 1 to 3, cut-out handles 16, 17 have been also provided, at two levels: handle 16, above the level of score lines 11, 12, 13, 14 for transporting the package and handle 17 under the folding level 10 for transporting the display means.

According to a preferred embodiment of the invention, the upper edges of the sides 5, 6, 7, 8 of the casing 2 are folded to form a support frame 18 for stacking several packages.

The impervious cup 9–9' may be connected with casing 2 in any suitable manner, e.g. by adhesive, fasteners, etc.

As regards the embodiment shown in FIGS. 4 and 5, the cut according to the line 23 has been shown inclined relative to the casing 2, but it is apparent that a cut perpendicular to the casing may be also provided to obtain a parallelepipedic display means, is being also possible to provide any other cut forming a pleasant display means.

In order to obtain a satisfactory support of the foil 20 in the casing 2, it is also possible to make foil 20 integral with the cup 9'' by any suitable means, e.g. by adhesive, fasteners, etc.

In this way, there is obtained a package providing a maximum protection for the flowers transported therein, it being possible to very readily convert the package into a display means to form an original presentation of cut flowers, the package having a very low cost.

The invention has been described and illustrated by way of a non limitative examples and it is apparent that numerous modifications may be made without departing from the scope of the invention as defined in the appended claims.

What is claimed is:

1. A package convertible into a display means for selectively transporting, storing and displaying cut flowers having stems, which comprises (a) a topless box-shaped casing cardboard having providing the free circulation of air and a plurality of side walls of a height sufficient for accommodating the cut flowers disposed in a vertical position, (b) a cup of a water-impervious material at a lower portion of the casing and permanently connected therewith to form a part of the casing, for containing water, (c) score lines on the side walls of the casing defining a plane above the cup for cutting the side walls along said lines when the package is converted into the display means, (d) a support for the cut flowers extending above the cup and defining at least one opening for receiving the stems of the flowers when the side walls are cut and the package has been converted into the display means, and (e) the upper edges of the side walls being inwardly folded to form a support frame around the edges only, thereby permitting the stacking of several packages.

2. The convertible package of claim 1, further comprising additional score lines on the side walls defining a plane above the cup but below the first-named plane and enabling the side walls of the casing to be folded inwardly along the additional score lines after the walls have been cut along the first-named score lines and along the vertical edges joining the side walls between the first-named and additional score lines, the first-named score lines consisting of two straight lines on two opposite small side walls of the casing and two straight lines with a curved notch at the centers thereof on two opposite large side walls whereby the inwardly folded side wall portions form the support for the cut flowers with the opening defined by the facing curved notches, the cutting and folding of the casing converting the package into a parallelepiped display means.

3. The convertible package of claim 1, wherein the casing comprises a bottom wall, the cup being consitituted by a lining of water-impervious material conforming in shape to the side and bottom walls of the casing and being permanently connected therewith.

4. The convertible package of claim 3, wherein the lining consists of a bag of flexible, water-impervious material.

5. The convertible package of claim 1, wherein the casing is bottomless and the cup being permanently connected with the side walls and forming the bottom of the casing.

6. The convertible package of claim 5, wherein the cup is of a rigid, water-impervious material.

7. The convertible package of claim 1, wherein the cup has a support rim and the support is disposed on the support rim of the cup.

8. The convertible package of claim 7, wherein the support is a foil defining a plurality of said openings.

9. The convertible package of claim 1, wherein the cup has a ribbed bottom preventing the stems of the cut flowers from sliding along the bottom of the cup.

* * * * *